US010874189B2

(12) United States Patent
Courtin

(10) Patent No.: US 10,874,189 B2
(45) Date of Patent: Dec. 29, 2020

(54) DEVICE FOR DISPENSING A FLUID PRODUCT

(71) Applicant: Karine Courtin, Boulogne-Billancourt (FR)

(72) Inventor: Karine Courtin, Boulogne-Billancourt (FR)

( * ) Notice: Subject to any disclaimer, the term of this patent is extended or adjusted under 35 U.S.C. 154(b) by 0 days.

(21) Appl. No.: 16/308,117

(22) PCT Filed: Jun. 9, 2017

(86) PCT No.: PCT/FR2017/051459
§ 371 (c)(1),
(2) Date: Dec. 7, 2018

(87) PCT Pub. No.: WO2017/212183
PCT Pub. Date: Dec. 14, 2017

(65) Prior Publication Data

US 2019/0159573 A1 May 30, 2019

(30) Foreign Application Priority Data

Jun. 10, 2016 (FR) ..... 16 55395

(51) Int. Cl.
*A45D 34/04* (2006.01)
*B65D 83/00* (2006.01)
(Continued)

(52) U.S. Cl.
CPC ..... *A45D 34/04* (2013.01); *A45D 34/00* (2013.01); *B65D 47/2031* (2013.01); *B65D 83/0033* (2013.01); *B65D 83/0038* (2013.01)

(58) Field of Classification Search
CPC .... A45D 34/00; A45D 34/04; B65D 47/2031; B65D 83/0033
(Continued)

(56) References Cited

U.S. PATENT DOCUMENTS 4,913,322 A * 4/1990 Stoffler ..... B05B 11/0072 222/207
5,310,094 A * 5/1994 Martinez ..... B05B 11/0075 222/212
(Continued)

FOREIGN PATENT DOCUMENTS

DE 202007002677 U1 8/2008
EP 3023026 A1 5/2016
(Continued)

OTHER PUBLICATIONS

International Search Report for International Application No. PCT/FR2017/051459, dated Jul. 28, 2017.
(Continued)

*Primary Examiner* — Vishal Pancholi
(74) *Attorney, Agent, or Firm* — Pearne & Gordon LLP

(57) ABSTRACT

A device for dispensing a fluid product, comprising a rigid cylindrical body having a vertical main axis, a rigid piston which is oriented essentially horizontally and which can slide vertically inside the body, and an upper extraction wall which closes the upper end of the body. According to the invention, the body, the piston and the upper wall define a space that is intended to be filled with the product to be dispensed. In addition, the upper wall comprises a slotted cover that can open in order to connect the space to the exterior. The upper wall is elastically deformable and can deform into the space when a pressure is exerted manually on the upper wall, so as to increase the pressure inside the space and cause the slotted cover to open.

10 Claims, 2 Drawing Sheets

(51) Int. Cl.
*B65D 47/20* (2006.01)
*A45D 34/00* (2006.01)

(58) Field of Classification Search
USPC ..... 222/406, 407, 340, 386, 490, 494
See application file for complete search history.

(56) References Cited

U.S. PATENT DOCUMENTS 5,513,778 A * 5/1996 Cardia ..... A45D 40/0075 222/327
5,577,641 A * 11/1996 De Laforcade ..... B29C 45/1676 222/386
8,042,714 B2 * 10/2011 Miyazaki ..... B65D 47/2031 222/105
8,371,480 B2 * 2/2013 Wang ..... A45D 34/04 222/319
9,248,462 B2 * 2/2016 Csaszar ..... B05B 11/0008
2008/0210711 A1 * 9/2008 Riesle ..... B65D 83/0038 222/153.13
2009/0230152 A1 * 9/2009 Decottignies ..... A45D 40/0075 222/319
2012/0067924 A1 * 3/2012 Deans ..... B65D 83/0033 222/256
2013/0092709 A1 * 4/2013 Salem ..... A61J 7/0053 222/326
2015/0108174 A1 * 4/2015 Py ..... G01F 11/021 222/380
2016/0157581 A1 * 6/2016 Kim ..... A45D 34/04 222/386
2017/0267424 A1 9/2017 Courtin
2018/0009575 A1 1/2018 Courtin
2018/0186518 A1 7/2018 Courtin

FOREIGN PATENT DOCUMENTS

FR 1359844 A 4/1964
FR 2791329 A1 * 9/2000 ..... G09F 5/04
FR 2791329 A1 9/2000
FR 2869771 A1 11/2005
FR 3011826 A1 4/2015

OTHER PUBLICATIONS

Preliminary French Search Report for French Patent No. 1655395 dated Jan. 5, 2017.

* cited by examiner

DEVICE FOR DISPENSING A FLUID PRODUCT

TECHNICAL FIELD

The invention relates to a fluid dispensing device, which is for preventing air oxidation of the fluid contained in the device and for preserving this fluid from the development of yeasts and bacterial contaminations for example.

The invention relates in particular to a device for dispensing a cream, a paste, a gel or a liquid for the cosmetic, chemical, pharmaceutical or food industry, which is contained in a rigid container.

The invention aims at reducing the number and amount of additives which are incorporated to the products for the purpose of conserving and preserving the product. Reducing such additives comes from an action taken by health authorities and consumers.

STATE OF PRIOR ART

Many products having a paste or liquid form are contained in containers which provide both protection and dispensing of these products.

Such a container is hermetically sealed, in particular to limit oxidation risks for the product.

Thus, many preservative compounds such as for example antioxidant, bactericidal or antifungal compounds are incorporated to the product. Such compounds only participate indirectly, or even do not participate, in the action of the basic formulation of the product.

Therefore, there are pollution risks for the product which occur upon dispensing the product using the container.

The container generally comprises a sampling outer surface, on which a dispensing port, connecting the internal volume of the container with the outside, opens.

The sampling action of the product is made on this sampling surface, for example according to a sweeping action of a finger on the same. Thereby, there is a build-up of many external pollutants on the sampling surface and a risk of contaminating the rest of the product contained in the internal volume of the container.

This real contamination risk in the case of tubes for which the dispensing port is continuously open is a major risk for jars having a large opening area.

Document FR-3.011.826 describes a slit stopper for being assembled to such a container and which prevents the pollutants that can be present on the sampling face, as well as air, from penetrating in the internal volume of the container during, or at the end of, a product sampling operation.

This plug is able to be mounted to a jar with rigid walls, the wall forming the bottom of which is movable and is able to be moved with respect to the other walls, under the action of the user. This user's action generates an increase in the pressure of the product in the container, which results in opening the slit stopper and outputting a defined amount of product.

The movement of the movable wall enables the product volume which has been sampled to be compensated for. However, for the use of this dispensing device, the user has to take the container with both his/her hands, which is not ergonomic.

According to another embodiment, the movable wall of the rigid jar is the upper wall, on which the slit stopper is placed.

This embodiment enables the user to exert the action on the movable wall in order to cause the pressure increase, with the same finger as that used for sampling the product.

The use of the dispensing device is thereby improved with respect to a dispensing device for which the bottom is movable.

However, as the product is sampled, the movable upper wall is more and more depressed into the device, which makes the sampling less and less easy.

According to another type of dispensing device, this includes a container with rigid walls as well as a mini dispensing pump. This pump enables, also, air to be prevented from penetrating in the internal volume of the container and it includes to that end a movable piston which is lifted at each dispensing to compensate for the volume of product sampled.

This pump consists of a large number of components with different natures. The production cost of this pump is thus not negligible, which consequently increases the selling price of the dispensing device.

Besides, the product extracted by this pump must be sampled quickly by one hand by the user, the other holding the dispensing device. The use of the dispensing device is thereby not easy.

The purpose of the invention is to provide a fluid dispensing device which is able to be handled with a single hand both to output an amount of product off the container and to sample this amount of product.

DISCLOSURE OF THE INVENTION

The invention provides a dispensing device for dispensing a fluid product including a rigid cylindrical body the main axis of the body of which is vertically oriented, a rigid lower piston mainly horizontally oriented and which is slidably movable along the vertical direction inside the body, and an upper sampling wall which plugs the upper end of the body, wherein the body, the lower piston and the upper wall delimit a volume for being filled by a product to be dispensed;

wherein said upper wall includes a slit stopper which is able to be opened to enable said volume to be connected with the outside, characterised in that said upper wall is elastically deformable and is able to be deformed inwardly of said volume when a pressure is manually exerted on the upper wall, to cause an increase in the pressure inside the volume and cause the slit stopper to be opened.

Providing the dispensing device with such an upper wall enables a user by directly pressing on the upper wall, to output an amount of product to be dispensed. Then, the user has only to sweep the outer face of the upper wall to sample the output amount of product.

Preferably, the dispensing device includes means for preventing the piston from moving apart from the upper wall when a pressure is exerted on the upper wall.

Preferably, the piston bears an O-ring which is radially compressed between an inner cylindrical wall of the body and a wall of the piston, said wall of the piston including a conical-shaped segment opened into the upper wall against which the O-ring bears when the piston is driven to move apart from the upper wall.

Preferably, the dispensing device includes means for movingly driving the piston to the upper wall.

Preferably, the driving means include a spring which is vertically compressed between the piston and a bottom plate attached to the lower end of the body.

The invention also relates to a dispensing device for dispensing a fluid product including a rigid cylindrical body the main axis of the body of which is vertically oriented, a rigid piston mainly horizontally oriented and which is slidably movable along the vertical direction inside the body, and an upper sampling wall which plugs the upper end of the body, wherein the body, the piston and the upper wall delimit a volume for being filled by a product to be dispensed;

wherein said upper wall includes a slit stopper which is able to be opened to enable said volume to be connected with the outside, wherein said upper wall is elastically deformable and is able to be deformed inwardly of said volume when a pressure is manually exerted on the upper wall, to cause an increase in the pressure inside the volume and cause the slit stopper to be opened, characterised in that it includes a spring which is vertically compressed between the piston and a bottom plate attached to the lower end of the body to prevent the piston from moving apart from the upper wall when a pressure is exerted on the upper wall.

Preferably, the bottom plate includes a vent connecting the volume delimited by the body, the piston and the bottom plate with the outside.

Preferably, the piston includes an upper face which is facing the lower face of the upper wall and the shape of the upper face of the piston is complementary to the shape of the lower face of the upper wall.

Preferably, the upper wall is of an upwardly bulged convex dome shape.

Preferably, the dispensing device includes a removable lid which is for covering the upper wall and which is removably mounted to the upper end of the body.

Preferably, the shape of the lid is complementary to the shape of the upper wall and the lid includes a layer of bactericidal material which contacts at least one part of the upper wall when the lid is mounted to the upper end of the body.

Preferably, the upper end of the body includes a peripheral groove which receives a part complementary to the upper wall.

BRIEF DESCRIPTION OF THE DRAWINGS

Further characteristics and advantages of the invention will appear upon reading the detailed description that follows for the understanding of which the appended figures will be referred to, among which.

DETAILED DISCLOSURE OF PARTICULAR EMBODIMENTS

Figure 1:
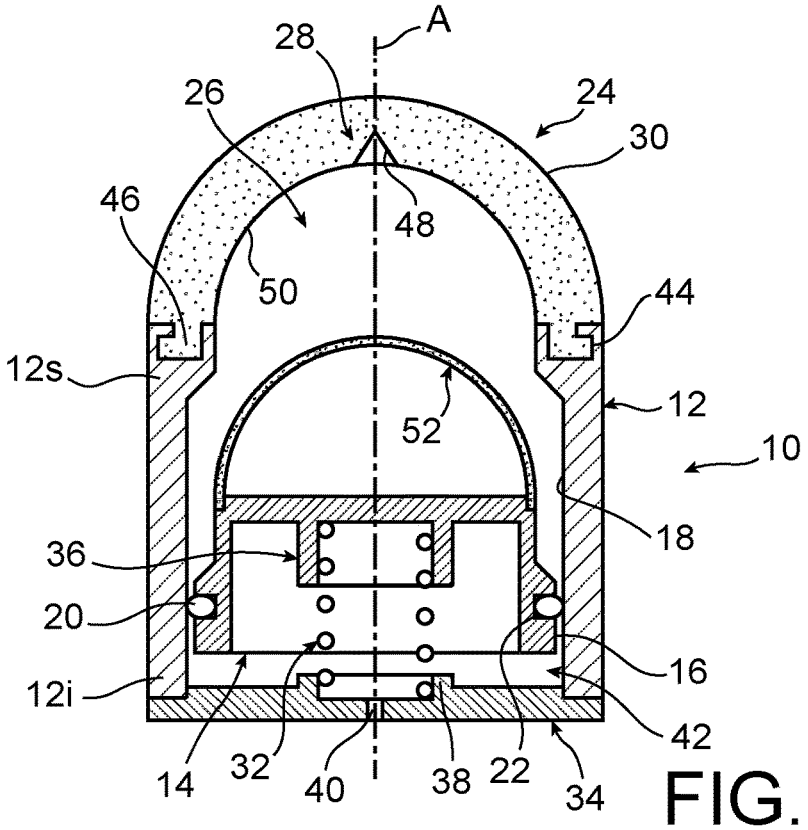
FIG. 1 is a cross-section schematic representation of a dispensing device for dispensing a fluid product made according to the invention along its main median vertical plane.

A dispensing device 10 for dispensing a fluid product is represented in FIG. 1.

By way of non-limiting examples, the product consists of a cream, a paste or a gel and it is for use in cosmetics or food.

The dispensing device 10 includes a cylindrical, or tubular, shaped rigid body 12, with a vertical main axis A. By way of non-limiting example, the cross-section of the body 12 along a horizontal plane is circular, being centred on the main axis A, that is the body is a cylindrical revolving element. It will be understood that the invention is not limited to a revolving shape of the body 12 and that the invention is concerned with any tubular shape as for example a square, rectangular or oval cross-section tube.

The dispensing device 10 also includes a horizontal lower wall 14 forming a piston which is movably slidably mounted with respect to the body 12 along the vertical main axis A of the dispensing device 10.

Slidably guiding the piston 14 with respect to the body 12 is performed by cooperating the peripheral wall 16 of the piston 14 with the inner cylindrical wall 18 of the body 12. To that end, the peripheral wall 16 of the piston 14 is cylindrical, or tubular, being centred on the main axis of the dispensing device 10 and it has the same shape as the inner cylindrical wall 18 of the body 12.

A clearance is present between both facing walls 16, 18, to enable the piston 14 to slide with respect to the body 12.

Sealing means are interposed between the peripheral wall 16 of the piston 14 and the inner cylindrical wall 18 of the body 12. Here, the sealing means consist of one or more O-rings 20, each of which being received in a peripheral throat 22 formed in the peripheral wall 16 of the piston 14 and each O-ring 20 is radially compressed, with respect to the main axis A between the peripheral wall 16 of the piston 14 and the inner cylindrical wall 18 of the body 12.

The dispensing device 10 also includes an upper wall 24 which closes the upper end 12*s* of the body 12.

Thus, the whole formed by the body 12, the piston 14 and the upper wall 24 delimits a closed volume 26 in which the product to be dispensed is stored.

The upper wall 24 includes a slit stopper 28 which is able to be opened to enable the product to the output outwardly for being sampled and which is normally in a hermetically sealed position in which the slit stopper 28 holds the closed volume 26 isolated from the outside.

An exemplary embodiment of the slit stopper 28 is described in document FR-1.359.844.

The slit stopper 28 is able to be opened when the pressure of the product to be dispensed in the closed volume 26 is higher than a predefined pressure. If the pressure is lower than this predefined pressure, the plug 28 remains in its closing configuration.

Further, when the slit stopper 28 is opened, the pressure in the closed volume is also higher than the external pressure, which causes an amount of product present in the closed volume 26 to be output, which is thereby deposited onto the external surface 30 of the upper wall 24.

When the pressure of the product in the closed volume 26 decreases, the slit stopper 28 is re-closed by elastic return.

Preferably, the slit stopper 28 includes two movable faces facing each other and which form the slit and are able to be moved apart to open the slit stopper 28 or to move closer up to contact each other to close the slit stopper. Thus, when they move closer to each other, they cause a flow of the product preventing any foreign compound from the outside from penetrating in the closed volume 26.

Then, the user sweeps this external surface 30 of the upper wall 24, for example with a finger, to sample the amount of product which rests on the external surface 30 of the upper wall 24.

The upper wall 24 is made of an elastically deformable material. Thus, when a user exerts a pressure on the upper wall 24, the upper wall 24 is deformed and transmits the undergone pressure to the fluid present in the closed volume 26. The pressure in the closed volume 26 thereby increases as a function of the pressure exerted by the user, until the product output is achieved, as has been previously described.

When the user terminates its action onto the upper wall 24, this automatically returns to its initial shape, which causes a decrease in the pressure in the closed volume 26 and consequently closing of the slit stopper 28.

Since some amount of product has been sampled, the amount of product present in the closed volume 26 has decreased. Consequently, the volume of product in the closed volume 26 has also decreased.

To compensate for this variation in the product volume in the closed volume 26, the piston 14 slides towards the upper wall 24, that is herein upwardly, with respect to the body 12 by a distance corresponding to the variation of volume of the product.

The dispensing device 10 also includes means for preventing the piston 14 from moving away from the upper wall 24, that is a downwardly sliding of the piston 14, when a pressure is exerted onto the upper wall 24.

Figure 2:
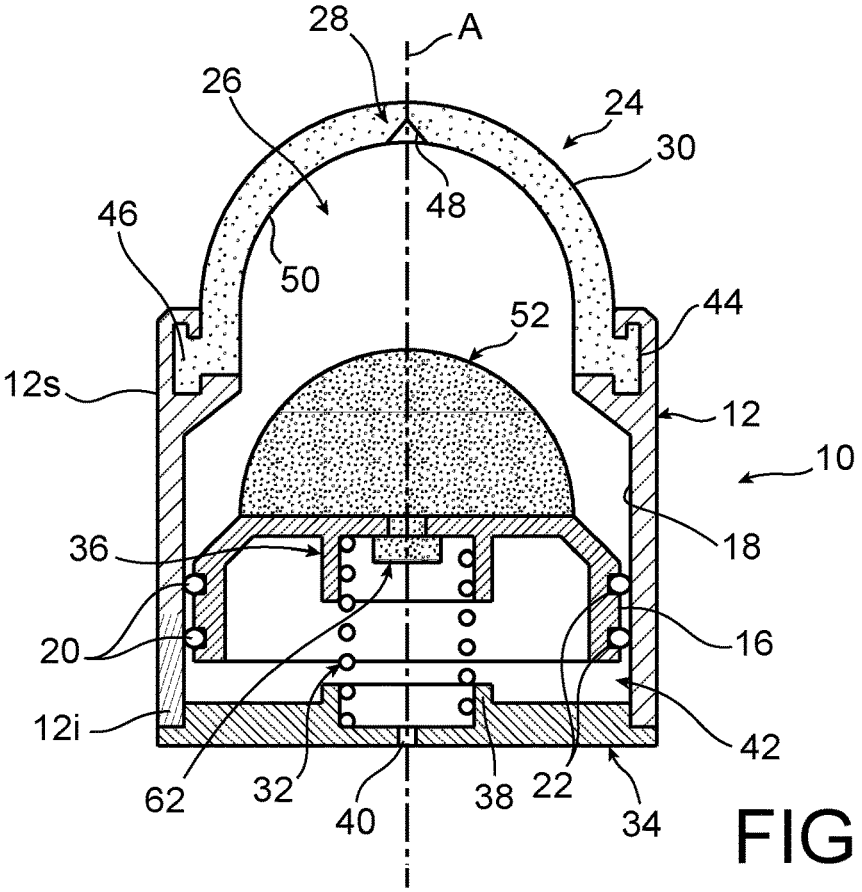
FIG. 2 is a similar view to that of FIG. 1, showing an alternative embodiment of the invention.
Figure 3:
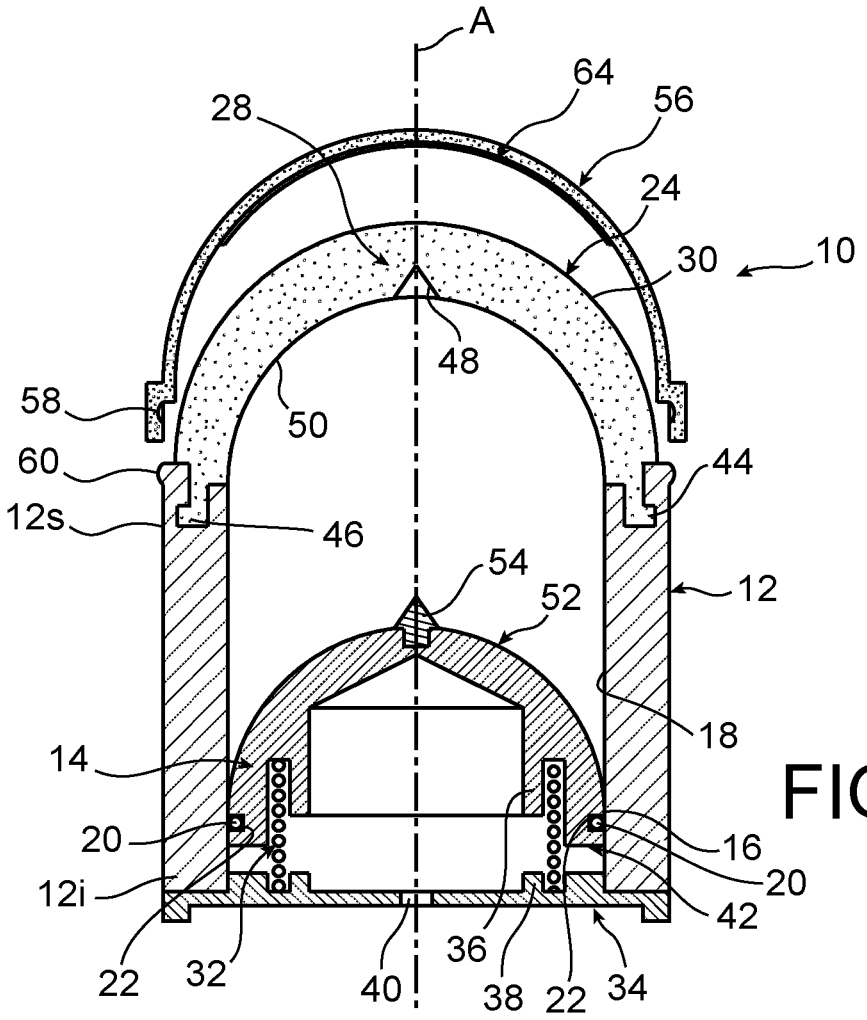
FIG. 3 is a view similar to that of FIG. 1, showing another alternative embodiment of the invention in which the dispensing device is represented filled with the fluid product to be dispensed and equipped with a protective lid.

According to the embodiment represented in FIGS. 1 to 3, the dispensing device 10 includes a spring 32 which bears against a lower face 14*i* of the piston 14 and which exerts on the piston 14 a strain oriented to the upper wall 24.

Thus, the spring 32 generates an initial pressure of the product present in the closed volume 26. This pressure generated by the spring is lower than the pressure causing the slit stopper 28 to open.

The spring 32 here consists of a helical spring which is vertically compressed between the piston 14 and a bottom lower plate 34 which closes the lower end 12*i* of the body 12. This bottom plate 34 further forms a basis for the dispensing device 10, by which the dispensing device 10 can be laid on a support.

Each of the piston 14 and the bottom plate 34 includes a cylindrical barrel 36, 38 in which one end of the spring 32 is received. These barrels 36, 38 enable the spring 32 to be guided in order to maintain it in its vertical orientation and avoid any warpage thereof.

Figure 4:
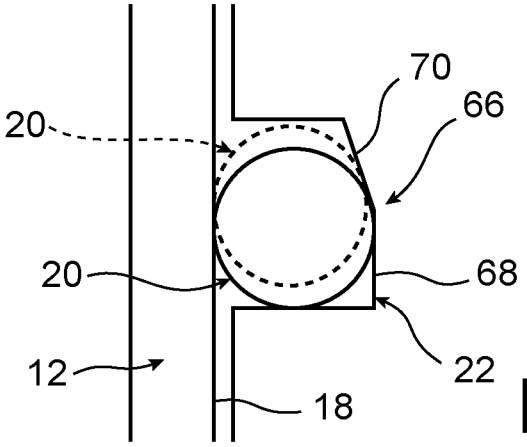
FIG. 4 is a detail on a larger scale of a dispensing device showing one embodiment of anti-piston return means.

According to another embodiment represented in FIG. 4, the means for preventing the piston 14 from moving away from the upper wall 24 when a pressure is exerted onto the upper wall 24 are formed by the O-ring 20 which is able to be wedged between the inner cylindrical wall 18 of the body 12 and a bottom wall 66 of the peripheral throat 22 receiving the seal.

The bottom wall 66 includes a cylindrical lower segment 68 and an upper segment 70 which is an extension of the lower segment 68 to the upper wall 24 and of a conical shape. The upper segment 70 is in the form of a cone opened to the upper wall 24, that is its diameter increases as it moves closer to the upper wall 24.

The diameter of the lower segment 68 is slightly higher than the internal diameter of the O-ring 20, the diameter of the upper segment 70 is consequently also higher than the internal diameter of the O-ring 20 at any point. That enables the O-ring 20 to be radially compressed between the inner cylindrical wall 18 of the body 12 and the bottom wall 66.

When the O-ring 20 is located in the throat 22 at the lower segment 68, the radial compression of the O-ring 20 is substantially constant.

Besides, since the diameter of the upper segment 70 increases as it moves closer to the upper wall 24, the radial compression of the O-ring 20 increases as the position of the O-ring 20 in the throat 22 is located at the upper segment 70 and as it moves closer to the upper wall 24.

When the piston 14 tends to be moved to the upper wall 24, the friction strains between the O-ring 20 and the inner cylindrical wall 18 of the body 12, which result from the radial compression of the O-ring 20, hold the O-ring 20 at the lower segment 68.

In this case, the radial compression of the O-ring 20 produces friction strains the value of which does not prevent the piston 14 from moving to the upper wall 24.

When the piston 14 tends to be moved to the bottom plate 34, that is to move away from the upper wall 24, the friction strains between the O-ring 20 and the inner cylindrical wall 18 of the body 12, which result from the radial compression of the O-ring 20, hold the O-ring 20 at the upper segment 70, as is represented in dotted line in FIG. 4. It is in particular the case when a pressure is exerted onto the upper wall 24.

At this stage, the radial compression of the O-ring 20 produces friction strains which increase as the O-ring 20 moves closer to the upper end of the upper segment 70.

These friction strains then become high enough to prevent the piston 14 from moving away from the upper wall 24.

The piston 14 is therefore slidably blocked to the bottom plate 34.

When the pressure on the upper wall 24 is released, the piston 14 lifts to the upper wall 24, as described above. The O-ring 20 is repositioned at the lower segment 68 of the bottom wall 66. The friction strains are thereby reduced and do not oppose the movement of the piston 14 to the upper wall 24.

Therefore, the piston 14 can be moved to the upper wall 24, either by the suction effect when the upper wall 24 returns to its initial shape or by the action of the spring 32.

It will be understood that the invention is not limited to these means and that the dispensing device can further include anti-return means, which prevent the piston 14 from being downwardly moved, moving away from the upper wall 24 and which enable the piston 14 to slide to the upper wall 24, that is upwardly, with respect to the body 12. These anti-return means can further be combined with the driving means just described above.

The bottom plate 34 also includes a vent 40 connecting the volume 42 delimited by the body 12, the piston 14 and the bottom plate 34, with the surrounding air, to avoid any depression in this volume 42, which would result from the upward movement of the piston 14 and which would impede this movement of the piston 14.

The shape of the upper wall 24 is defined to facilitate sampling of the product by the user. Here, the upper wall 24 is of an upwardly bulged hemispherical dome shape. It will be understood that the invention is not limited to this hemispherical shape and that the upper wall 24 can be planar or have any upwardly bulged convex shape.

The material making up the upper wall 24 is preferably a material chosen from rubber, an elastomer or silicone.

The thickness of the upper wall 24 is defined as a function of the force the user has to apply to the upper face 30 in order to cause the upper wall 24 to be deformed and the slit stopper 28 to be opened.

The upper wall 24 is further made as a single piece by moulding on the body 12 in order to ensure both elements to be properly attached together as well as sealed to each other.

To that end, the upper end 12*s* of the body 12 includes a peripheral groove 44 in which a part 46 complementary to the upper wall 24 is received.

According to the embodiments represented in FIGS. 1 and 2, the upper end 12*s* of the body 12 includes an extra thickness enabling this groove 44 to be formed.

Achieving the slit stopper 28 consists for example in providing a cut-out in the upper wall 24 after the moulding operation.

A slit with tilted walls 48 is a downward extension of the cut-out, to facilitate moving apart the faces of the slit stopper 28 under the action of the product pressure.

The piston 14 includes an upper face which is facing the lower face 50 of the upper wall 24. The shape of the upper face of the piston 14 is complementary to the shape of the lower face 50 of the upper wall 24. Thus, when the piston 14 is contacting the lower face 50 of the upper wall 24, the closed volume 26 is substantially null. That means that there is substantially no product inside the dispensing device 10.

As has been previously said, the upper wall 24, and consequently its lower face 50 is of a dome shape.

The piston 14 includes to that end an upper dome 52 complementary to the lower face 50 of the upper wall 24.

According to an alternative embodiment represented in FIG. 3, the dome 52 includes a tip 54 which is complementary to the slit 48 with tilted walls, such that as little product as possible remains in the dispensing device 10.

According to an exemplary embodiment represented in FIG. 1, the dome 52 consists of a metal sheet which has been stamped and which is attached to the rest of the piston by any known means, for example by gluing. According to another exemplary embodiment, the dome 52 is made of plastic material.

According to the embodiment represented in FIG. 2, the dome 52 consists of a solid block, for example made from the same elastic material as the upper wall 24, which is attached to the rest of the piston 14 by any known means, for example, here, through a shoulder 62.

According to the embodiment represented in FIG. 2, the piston 14 is entirely in the form of the dome 52 complementary to the lower face 50 of the upper wall 24.

As can be seen in FIG. 3, the dispensing device 10 also includes a lid 56 which is for covering the upper wall 24. The lid 56 is in the form of a dome complementary to the shape of the upper face 30 of the upper wall 24. The lid 56 thus protects the upper wall 24 from any unwanted action which could cause an amount of product to be output and enhances sealing of the closure of the closed volume 26.

The lid 56 is removably mounted to the upper end 12*s* of the body 12 by clipsage or by screwing. To that end, the peripheral edge of the lid 56 includes shapes 58 which are for cooperating with complementary shapes 60 of the upper end 12*s* of the body 12.

Here, the lid 56 includes a layer 64 of a material having a bactericidal or bacteriostatic effect, such as for example copper or silver, which releases ions having a sterilising effect. This layer 64 contacts the upper wall 24 when the lid 56 is mounted to the body 12, thus providing a sterilisation action on the upper wall 24.

The extent of the layer 64 is preferably defined to contact the entire upper wall 24. However, it will be understood that the layer 64 can be of lower dimensions only to contact a part of the upper wall 24, centred on the slit stopper 28.

According to an alternative embodiment, the lid 56 does not include such a layer 64.

The sampling mode for the product contained in this dispensing device 10 enables the product to be sampled with the hand or finger which exerts the action onto the upper wall 24.

Further, it is possible to modify the amount of product which will be expelled. Indeed, depending on the position of the pressure towards the slit axis, the latter could be more or less easily opened, releasing a more or less large volume of product. For a pressure perpendicular to the slit, the extraction will be lower than for the same pressure exerted along the axis thereof.

Besides, in spite of its simple structure, there is no modification of the external aspect of the dispensing device 10, its comfort of use therefore does not decrease as the dispensing advances.

What is claimed is:

1. A dispensing device for dispensing a fluid product including a rigid cylindrical body the main axis of the body of which is vertically oriented, a rigid piston mainly horizontally oriented and which is slidably movable along the vertical direction inside the body, and an upper sampling wall which plugs the upper end of the body, wherein the body, the piston and the upper wall delimit a volume for being filled by a product to be dispensed;

wherein said upper wall includes a slit stopper which is able to be opened to enable said volume to be connected with the outside, wherein said upper wall is elastically deformable and is able to be deformed inwardly of said volume when a pressure is manually exerted on the upper wall, to cause an increase in the pressure inside the volume and cause the slit stopper to be opened, wherein the piston bears an O-ring which is received in a peripheral throat formed in a peripheral wall of the piston, wherein the O-ring is radially compressed between an inner cylindrical wall of the body and a bottom wall of the peripheral throat, said bottom wall of the peripheral throat including a conical-shaped segment opened into the upper wall against which the O-ring bears when the piston is driven to move apart from the upper wall for preventing the piston from moving apart from the upper wall when a pressure is exerted on the upper wall.

2. The dispensing device according to claim 1, further including means for movingly driving the piston towards the upper wall.

3. The dispensing device according to claim 2, wherein the driving means include a spring which is vertically compressed between the piston and a bottom plate attached to the lower end of the body.

4. The dispensing device according to claim 3, wherein the bottom plate includes a vent connecting the volume delimited by the body, the piston and the bottom plate with the outside.

5. The dispensing device according to claim 1, wherein the piston includes an upper face which is facing a lower face of the upper wall and in that the shape of the upper face of the piston is complementary to the shape of the lower face of the upper wall.

6. The dispensing device according to claim 1, wherein the upper wall is of an upwardly bulged convex dome shape.

7. The dispensing device according to claim 1, further including a removable lid which is for covering the upper wall and which is removably mounted on the upper end of the body.

8. The dispensing device according to claim 7, wherein the shape of the lid is complementary to the shape of the upper wall and the lid includes a layer of bactericidal material which contacts at least one part of the upper wall when the lid is mounted on the upper end of the body.

9. The dispensing device according to claim 1, wherein the upper end of the body includes a peripheral groove which receives complementary a part of the upper wall.

10. The dispensing device according to claim 1, wherein when a pressure on the upper wall is released, a decrease of the pressure in the volume is caused and provokes a movement of the piston towards the upper wall.

* * * * *